US009093732B2

(12) United States Patent
Bae et al.

(10) Patent No.: US 9,093,732 B2
(45) Date of Patent: Jul. 28, 2015

(54) LOW POWER, HIGH SPEED MULTI-CHANNEL CHIP-TO-CHIP INTERFACE USING DIELECTRIC WAVEGUIDE

(71) Applicant: Korea Advanced Institute of Science and Technology, Daejeon (KR)

(72) Inventors: Hyeon Min Bae, Seoul (KR); Ha Il Song, Daejeon (KR); Huxian Jin, Daejeon (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 28 days.

(21) Appl. No.: 14/103,005

(22) Filed: Dec. 11, 2013

(65) Prior Publication Data

US 2014/0184351 A1 Jul. 3, 2014

(30) Foreign Application Priority Data

Dec. 27, 2012 (KR) ..... 10-2012-0154094
Oct. 16, 2013 (KR) ..... 10-2013-0123344

(51) Int. Cl.

| | |
|---|---|
| ***H01P 3/12*** | (2006.01) |
| ***H01P 3/16*** | (2006.01) |
| ***H01P 5/08*** | (2006.01) |
| ***H01P 5/107*** | (2006.01) |

(52) U.S. Cl.
CPC *H01P 3/122* (2013.01); *H01P 3/16* (2013.01); *H01P 5/087* (2013.01); *H01P 5/107* (2013.01)

(58) Field of Classification Search
CPC ..... H01P 3/00; H01P 3/10; H01P 3/13; H01P 3/14; H01P 5/02
USPC ..... 333/253, 254
See application file for complete search history.

(56) References Cited

U.S. PATENT DOCUMENTS 5,892,414 A * 4/1999 Doughty et al. ..... 333/137

* cited by examiner

*Primary Examiner* — John Poos
(74) *Attorney, Agent, or Firm* — Fenwick & West LLP

(57) ABSTRACT

An exemplary embodiment of the present invention provides an improved dielectric waveguide named electrical fiber. The electrical fiber with a metal cladding may isolate the interference of the signals in other wireless channels and adjacent electrical fibers, which typically causes band-limitation problem, for a smaller radiation loss and better signal guiding to lower the total transceiver power consumption as the transmit distance increases. Also, the electrical fiber may have frequency independent attenuation characteristics to enable high data rate transfer with little or even without any additional receiver-side compensation due to vertical coupling of the electrical fiber and an interconnection device.

6 Claims, 14 Drawing Sheets

LOW POWER, HIGH SPEED MULTI-CHANNEL CHIP-TO-CHIP INTERFACE USING DIELECTRIC WAVEGUIDE

CROSS-REFERENCE TO RELATED APPLICATION

This application claims the priority benefit of Korean Patent Application No. 10-2012-0154094, filed on Dec. 27, 2012, and Korean Patent Application No. 10-2013-0123344, filed on Oct. 16, 2013 in the Korean Intellectual Property Office, the disclosure of which are incorporated herein by reference.

BACKGROUND

1. Field of the Invention

Exemplary embodiments of the present invention relate to a waveguide to propagate a signal on a low power—high speed multi-channel chip-to-chip interface using a dielectric waveguide.

2. Description of the Related Art

Ever increasing demand for bandwidth in the wire line communications necessitates high-speed, low-power, low-cost I/O. The drastic attenuation in the conventional copper wire line interconnects caused by skin effect in high frequencies limits the system performance. Penalty in receiver power, cost and area occurs to compensate for the loss in the interconnection, and increases exponentially as the data rate or transmit distance increases. A new chip-to-chip interface using dielectrics as transmitting channels is presented to resolve the problems mentioned above.

SUMMARY

An exemplary embodiment of the present invention includes an electrical fiber for a board-to-board interconnect between transceiver I/O. The electrical fiber may comprise a dielectric waveguide to propagate a signal from a transmitter side board to a receiver side board, and a metal cladding to wrap up the dielectric waveguide.

At least one of both ends of the dielectric waveguide may be tapered for impedance matching between the dielectric waveguide and microstrip circuits.

At least one of both ends of the dielectric waveguide is shaped linearly to optimize an impedance of the dielectric waveguide with largest power transfer efficiency.

The metal cladding comprises copper cladding.

The both end sides of the dielectric waveguide may be vertically coupled with the transmitter side board and the receiver side board.

A proportionality of a length of the metal cladding on a length of the dielectric waveguide is designed based on a length of the electrical fiber.

An exemplary embodiment of the present invention discloses an interconnection device with an electrical fiber, the interconnection device may comprise an electrical fiber to propagate a signal from a transmitter side board to a receiver side board with a metal cladding, and a microstrip circuit to contact with the electrical fiber with a microstrip-to-waveguide transition (MWT).

The interconnection device further comprises, a microstrip feeding line to feed the signal to the microstrip circuit at a first layer, a slotted ground plane including a slot to minimize a ratio of backward propagation wave to forward propagation wave at a second layer, a ground plane including an array of vias to make an electrical connection between the slotted ground plane and the ground plane at a third layer and a patch to radiate the signal at a resonance frequency.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION

Figure 1:
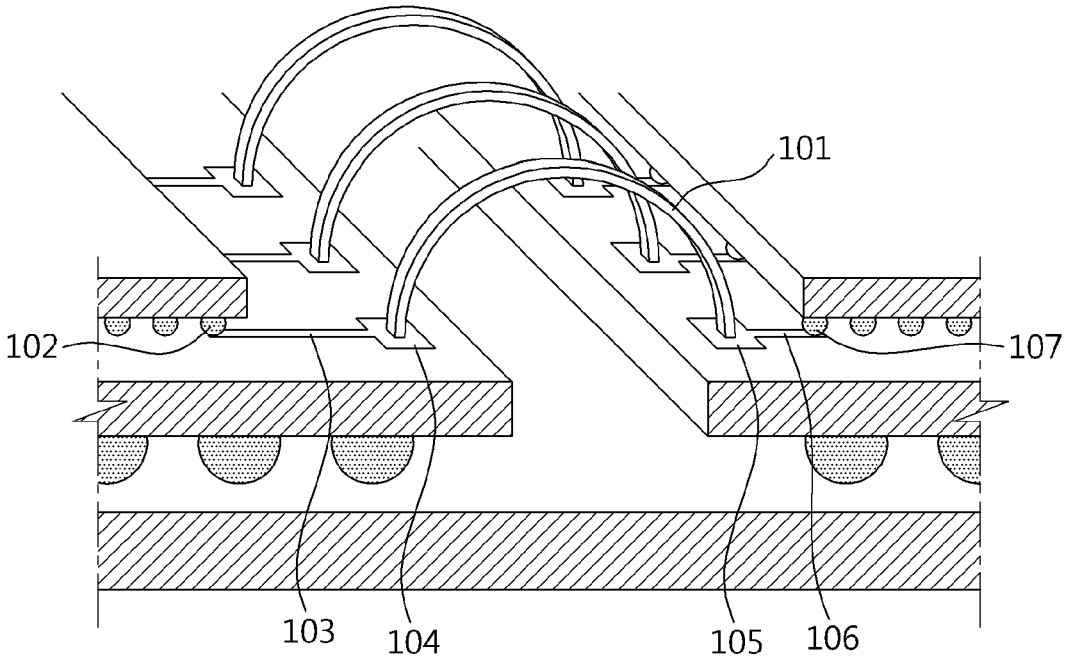
FIG. 1 shows an isometric perspective view according to an exemplary embodiment of the invention.

The invention is described more fully hereinafter with reference to the accompanying drawings, in which exemplary embodiments of the invention are shown. This invention may, however, be embodied in many different forms and should not be construed as limited to the embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

An exemplary embodiment of the present invention may provide an improved interconnect instead of electrical wire line. A novel type of dielectric waveguide named, for example, an electrical fiber may be presented to replace conventional copper line. The electrical fiber may be defined as a dielectric waveguide with metal cladding.

Dielectrics with frequency independent attenuation characteristics may enable high data rate transfer with little or even without any additional receiver-side compensation. Parallel channel data transfer may be available due to vertical coupling of the electrical fiber and PCB (printed circuit board). The PCB with the electrical fiber for board-to-board interconnect between transceiver I/O may be defined as a board-to-board interconnection device. For example, the interconnection device may comprise the electrical fiber, a transmitter side board, a receiver side board, a board-to-fiber connector, a microstrip feeding line, a slotted ground plane, a ground plane, and a patch. And, the interconnection device may comprise at least one via that makes an electrical connection between at least two ground planes.

A novel board-to-fiber connector may be presented to securely fix multiple the electrical fibers to PCB as close as to each other to maximize area efficiency. Physically flexible characteristic of the electrical fiber may support to connect any termination in any location in free space. The metal cladding of the electrical fiber may maintain the total transceiver power consumption regardless of a length of the electrical fiber. The cladding also may isolate the interference of the signals in other wireless channels and adjacent electrical fibers, which typically may cause band-limitation problem.

Slot coupled patch type microstrip-to-waveguide transition may be adapted to minimize the reflection between microstrip and waveguide. Microstrip-to-waveguide transition may transit microstrip signal into waveguide signal, and it may have the advantage of low cost because it may be available in general PCB manufacture process FIG. 1 shows an isometric perspective view according to an exemplary embodiment of the invention.

Referring to FIG. 1, an overall interconnect of an exemplary embodiment of the invention may be shown in isometric perspective view. FIG. 1 may illustrate the electrical fiber 101 used as a board-to-board interconnect. Incident signal may come from the 50-Ohm matched output of the transmitter die 102 to propagate along the transmission line 103 and then Microstrip-to-Waveguide Transition 104 (for example, MWT) on the transmitter side board may convert the microstrip signal into the waveguide signal. The wave, for example the waveguide signal, may transmit along the electrical fiber 101 and then may be converted into microstrip signal at the MWT 105 on the receiver side board. Likewise, signal may propagate along the transmission line 106 and then may go into the 50-Ohm matched receiver input 107. Herein, the dielectric waveguide may propagate a signal from the transmitter side board to the receiver side board.

Figure 2A:
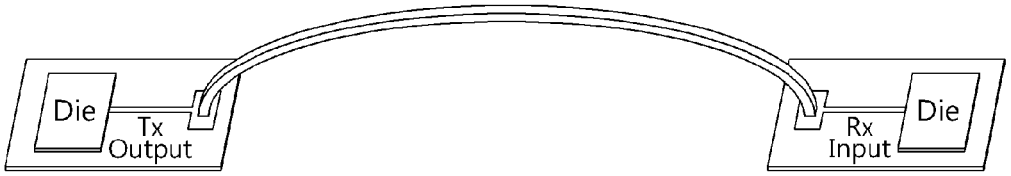
FIGS. 2*a* and 2*b* show a simplified model of the overall interconnect as a 2-port network and a relation between reflected waves and transmitted waves at each transitions according to an exemplary embodiment of the present invention.
Figure 2B:
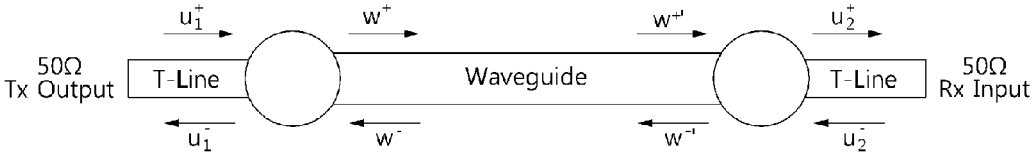
Figure 3A:
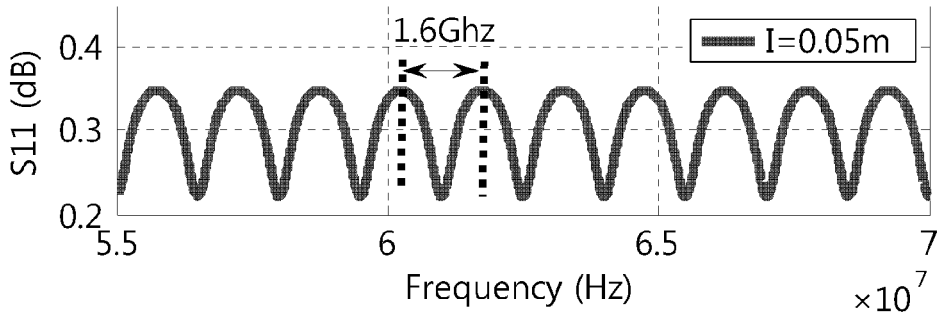
FIGS. 3*a*, 3*b*, 3*c*, and 3*d* show graphs of analytic estimation and simulated results for S-parameters of the overall interconnect constructed in accordance with the invention.
Figure 3B:
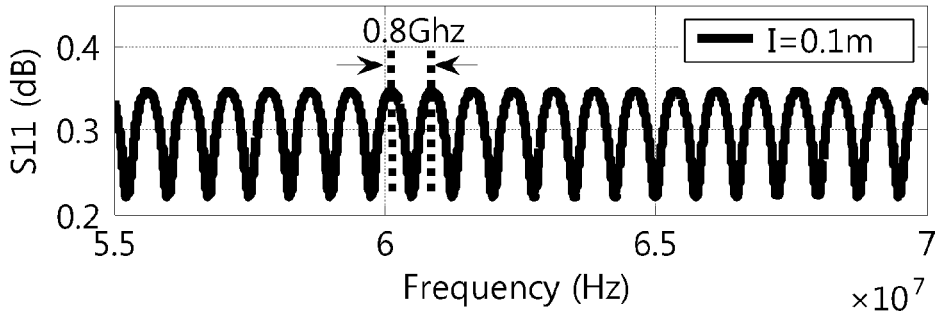
Figure 3C:
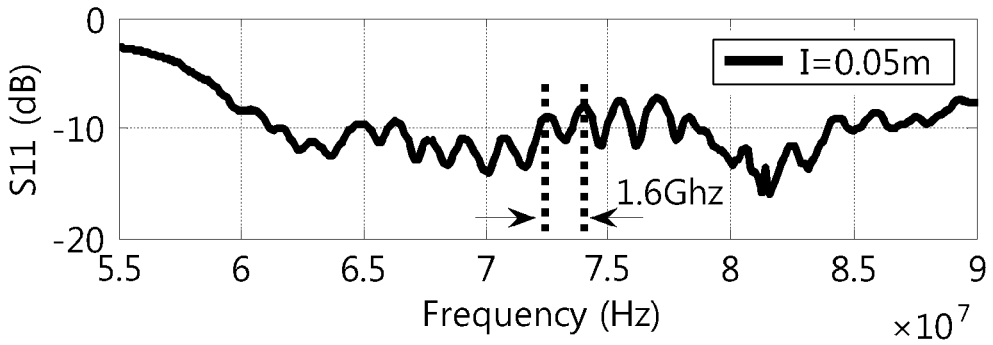
Figure 3D:
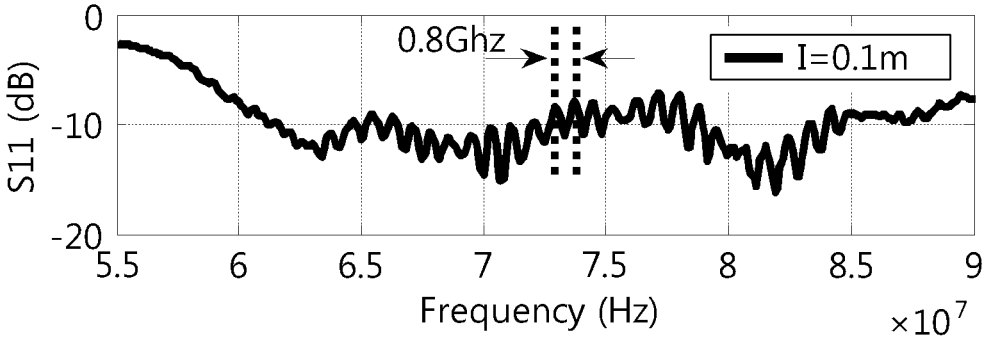
Figure 4A:
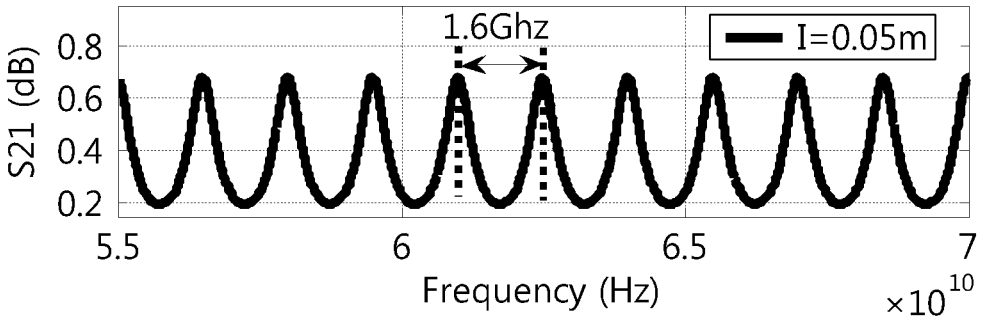
FIGS. 4*a*, 4*b*, 4*c*, and 4*d* show graphs of analytic estimation and simulated results for S-parameters of the overall interconnect constructed in accordance with the invention.
Figure 4B:
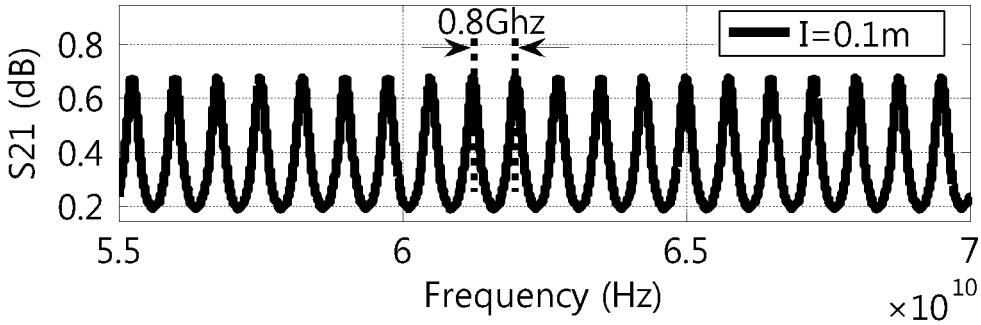
Figure 4C:
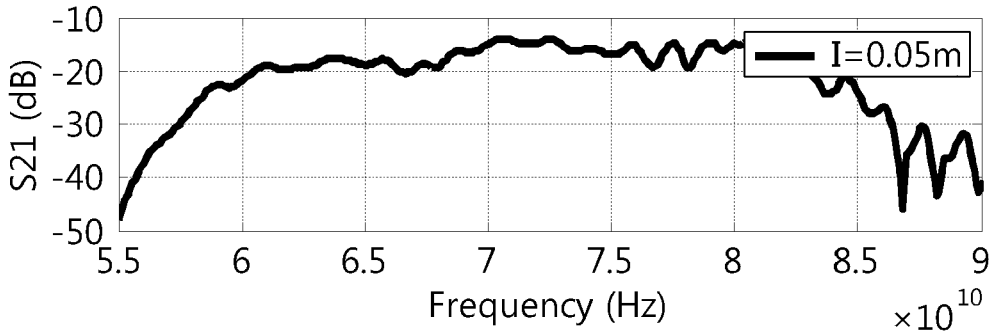
Figure 4D:
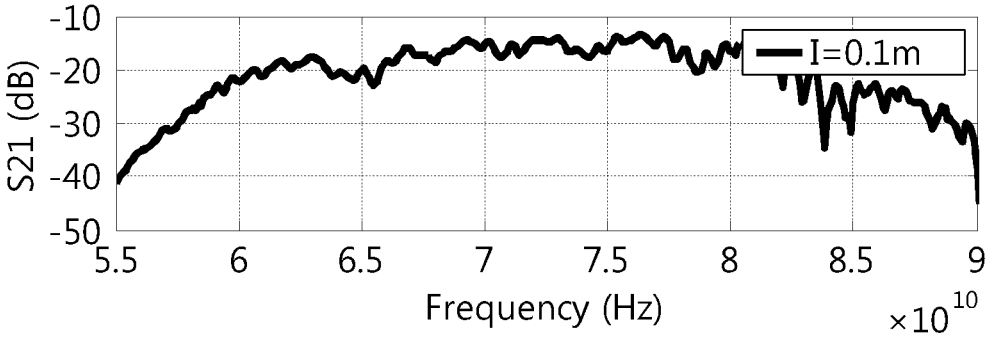

FIG. 2 shows a simplified model of the overall interconnect as a 2-Port network and a relation between reflected waves and transmitted waves at each transitions according to the exemplary embodiment of the present invention.

At each end side of the electrical fiber, impedance discontinuity may lead to inefficient transmission of energy both from the transmission line to the waveguide and from the waveguide to the transmission line. To analyze the effect of these discontinuities, overall interconnect may be considered as the simple 2-port networks as FIG. 2, Equation 1, Equation 2 and Equation 3.

$$\begin{bmatrix} u_1^- \\ w^+ \end{bmatrix} = \begin{bmatrix} r_1 e^{j\alpha_1} & t_2 e^{j\beta_2} \\ t_1 e^{j\beta_1} & r_2 e^{j\alpha_2} \end{bmatrix} \begin{bmatrix} u_1^+ \\ w^- \end{bmatrix} \quad \text{[Equation 1]}$$

$$\begin{bmatrix} w^{+\prime} \\ w^{-\prime} \end{bmatrix} = \begin{bmatrix} se^{-ikl} & 0 \\ 0 & se^{-ikl} \end{bmatrix} \begin{bmatrix} w^+ \\ w^- \end{bmatrix} \quad \text{[Equation 2]}$$

$$\begin{bmatrix} w^{-\prime} \\ u_2^+ \end{bmatrix} = \begin{bmatrix} r_2 e^{j\alpha_2} & t_1 e^{j\beta_1} \\ t_2 e^{j\beta_2} & r_1 e^{j\alpha_1} \end{bmatrix} \begin{bmatrix} u_1^+ \\ w^- \end{bmatrix} \quad \text{[Equation 3]}$$

At the transition from the transmission line to the waveguide, the incident waves on the transmission line side and on the waveguide side may be expressed as $u_1^+$ and $w^-$, respectively. And, the reflected waves may be expressed as $w^+$ and $u_1^-$. Likewise, at the transition from the waveguide to the transmission line, the incident waves on the waveguide side and on the transmission line side may be expressed as $w^{+'}$ and $u_2^-$. And, the reflected waves may be expressed as and $w^{-'}$ and $u_2^+$. From this simplified model, an equations of the relationship between the reflected waves and the transmitted waves may be made assumed that a complex reflection coefficient is $r_1 e^{j\alpha_1}$ and a complex transmission coefficient is $t_1 e^{j\beta_1}$ at the transition from the transmission line to the waveguide and a complex reflection coefficient is $r_2 e^{j\alpha_2}$ and a complex transmission coefficient is $t_2 e^{j\beta_2}$ at the transition from the waveguide to the transmission line.

The following equations may express a scattering matrix (for example, S-parameter) of the overall interconnect.

$$\begin{bmatrix} u_1^- \\ u_2^+ \end{bmatrix} = \begin{bmatrix} s_{11} & s_{12} \\ s_{21} & s_{22} \end{bmatrix} \cdot \begin{bmatrix} u_1^+ \\ u_2^- \end{bmatrix} \quad \text{[Equation 4]}$$

$$|S_{21}| = \left| s \frac{T_1 T_2 - R_1 R_2 - R_1}{E - E^{-1} R_2^2} \right|^2, \quad \text{[Equation 5]}$$

$$(T_i = t_i e^{i\beta_t},\ R_i = r_i e^{i\alpha_t},\ E = e^{ikl})$$

$$|S_{11}| = \left| \frac{E R_1 - E^{-1} R_2 (T_1 T_2 - R_1 R_2)}{E - E^{-1} R_2^2} \right|^2 \quad \text{[Equation 6]}$$

$$\text{Group Delay} = -\frac{d\angle S_{21}}{d\omega} \quad \text{[Equation 7]}$$

$$\angle S_{21} = \tan^{-1}\left( \frac{\text{Img}\{T_1 T_2\} - \text{Img}\{R_1 R_2\} - \text{Img}\{R_1\}}{\text{Re}\{T_1 T_2\} - \text{Re}\{R_1 R_2\} - \text{Re}\{R_1\}} \right) - \tan^{-1}\left( \frac{\text{Img}\{E\} - \text{Img}\{R_1 R_2 E^{-1}\}}{\text{Re}\{E\} - \text{Re}\{R_1 R_2 E^{-1}\}} \right) \quad \text{[Equation 8]}$$

Figure 5A:
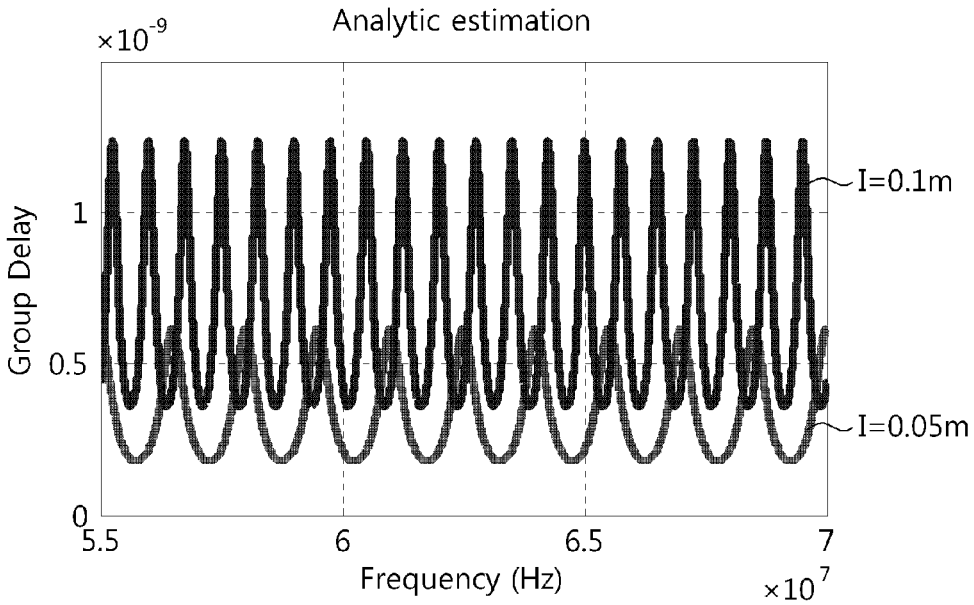
FIGS. 5*a* and 5*b* show graphs of analytic estimation and simulated results for group delay of the overall interconnect constructed in accordance with the invention.
Figure 5B:
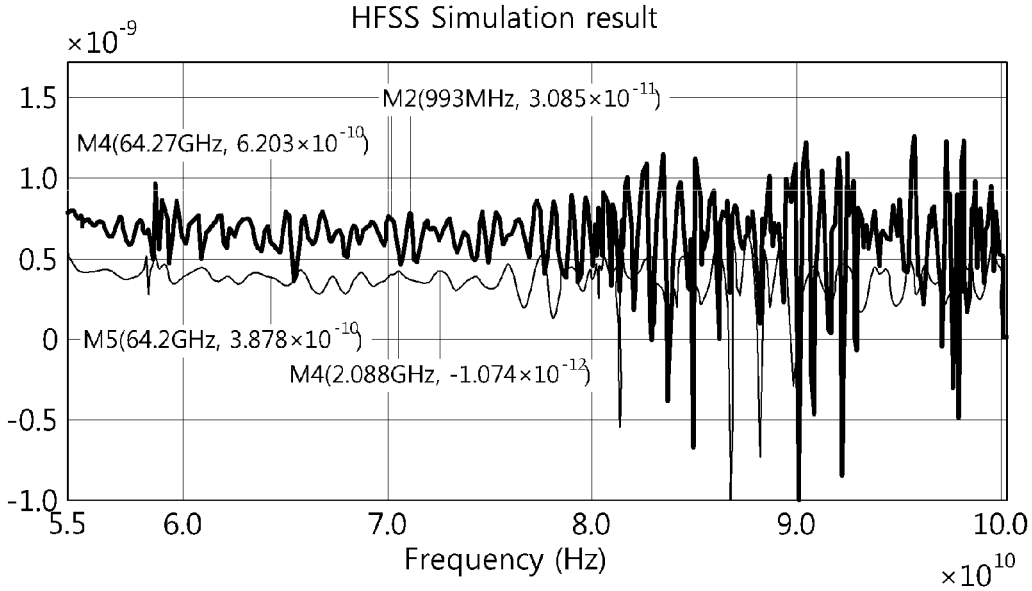

FIGS. 3*a*, 3*b*, 3*c*, and 3*d* show a graph of analytic estimation and simulated results for S-parameters of the overall interconnect constructed in accordance with the invention. FIGS. 4*a*, 4*b*, 4*c*, and 4*d* show a graph of analytic estimation and simulated results for S-parameters of the overall interconnect constructed in accordance with the invention. FIGS. 5*a* and 5*b* show a graph of analytic estimation and simulated results for Group Delay of the overall interconnect constructed in accordance with the invention.

FIGS. 3*a*, 3*b*, 3*c*, 3*d*, FIGS. 4*a*, 4*b*, 4*c*, and 4*d*, and FIGS. 5*a* and 5*b* may show a graph of analytic estimation results for S-parameters of the overall interconnect constructed in accordance with the exemplary embodiment of the invention. For example, FIGS. 3*a*, 3*b*, 3*c*, 3*d*, FIGS. 4*a*, 4*b*, 4*c*, and 4*d*, and FIGS. 5*a* and 5*b* may plot the above equation 5, equation 6, equation 7, and equation 8 and indicate the result from the different case of waveguide length (for instance, 5 cm and 10 cm). And each result may be compared to the simulation results from 3D Electromagnetic Simulation Tool (Ansys. HFSS).

FIGS. 3*a*, 3*b*, 3*c*, 3*d*, FIGS. 4*a*, 4*b*, 4*c*, and 4*d*, and FIGS. 5*a* and 5*b* may say that there exists a waveguide-length-dependent-oscillation in the results of S-parameters and Group Delay of the overall interconnect. The longer the waveguide is, the more serious the impact of the oscillation may be shown up. If the eye diagram is used as a metric for the evaluation of this transmission system, the oscillation may make serious problem on the eye opening and zero crossing and even be the major reason of increased bit error rate.

The oscillation in the results of S-parameters and Group Delay may result from the fact that the reflected wave occurred at the impedance discontinuity undergoes a slight attenuation along the propagation and it may make a phenomenon similar to what is happening in the cavity resonator. The wave may bounce back and forth within the electrical fiber and reinforce the standing wave.

Strategies for resolving this problem may be the followings: first, to make reflection coefficient (r2) as low as possible, second, to make proper attenuation along the electrical fiber while ensuring a relatively small level of channel loss, third, to use a low dielectric constant material for the waveguide. These strategies may be proved by the above equation 5, equation 6, equation 7, and equation 8. Accordingly, the MWT may be an object of the exemplary embodiment of the present invention to provide a lower reflection (r2).

Figure 6:
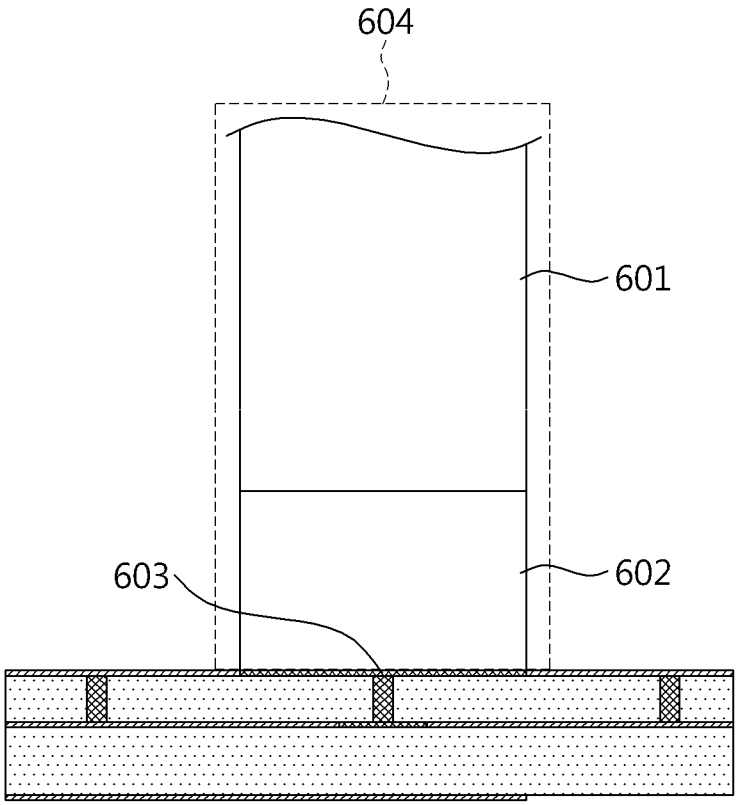
FIG. 6 shows a side view of a waveguide to microstrip transition constructed in accordance with one embodiment of the invention.
Figure 7:
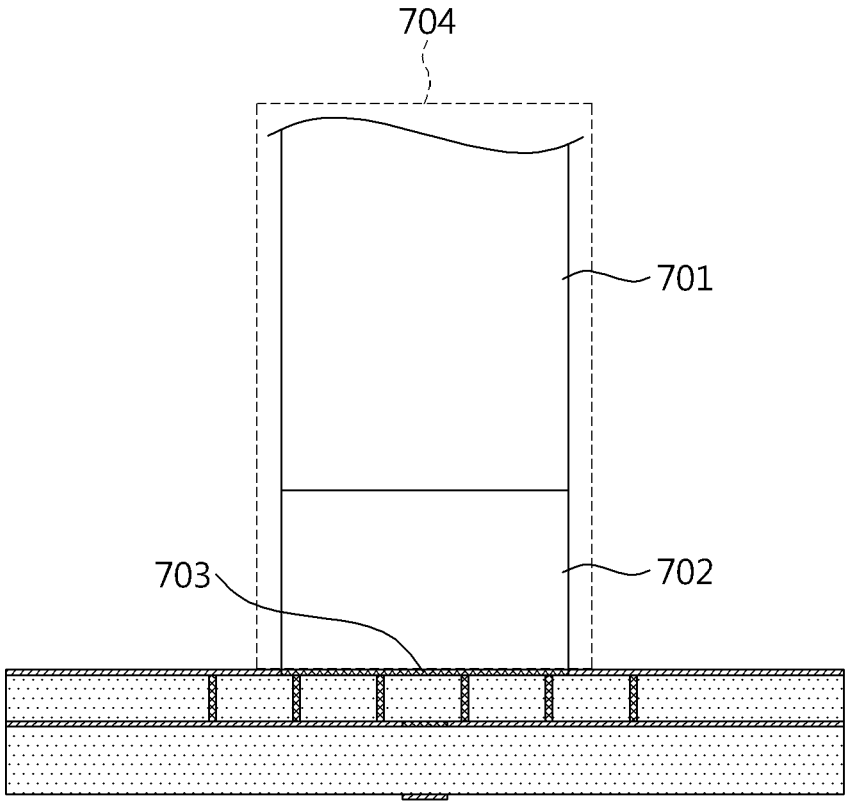
FIG. 7 shows a front view of a waveguide to microstrip transition constructed in accordance with one embodiment of the invention.

FIG. 6 shows a side view of a waveguide to microstrip transition constructed in accordance with one embodiment of the invention. FIG. 7 shows a front view of a waveguide to microstrip transition constructed in accordance with one embodiment of the invention.

FIG. 6 may show side view of the MWT and FIG. 7 may show front view of the MWT constructed in accordance with one embodiment of the invention. The electrical fiber 604, 704 with a metal cladding 601, 701 may be in contact with the microstrip circuit, especially with a patch element 603, 703 disposed on the board. Herein, the metal cladding 601, 701 may wrap up a dielectric waveguide 602, 702. For example, the metal cladding 601, 701 may comprise a copper cladding, and the patch element 603, 703 may comprise the microstrip line. The patch element 603, 703 may radiate the signal at a resonance frequency.

In accordance with an example of the present invention, the metal cladding 601, 701 may wrap up the dielectric waveguide 602, 702 with a predetermined form. For example, the predetermined form of the metal cladding 601, 701 may expose a middle of the dielectric waveguide 602, 702, and the predetermined form of the metal cladding 601, 701 may be punctured to expose a specific part of the dielectric waveguide 602, 702. Also the predetermined form of the metal cladding 601, 701 may be various form.

Figure 8:
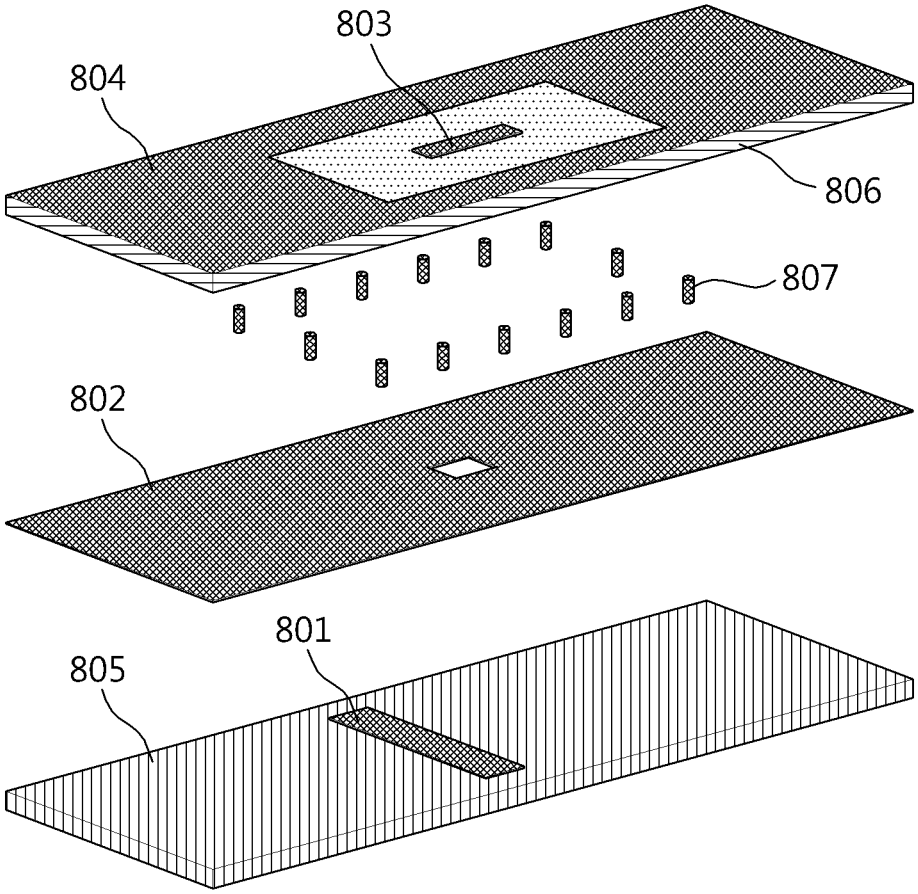
FIG. 8 shows an exploded view of a microstrip-to-waveguide transition constructed in accordance with one embodiment of the invention.

FIG. 8 shows an exploded view of a microstrip to waveguide transition constructed in accordance with one embodiment of the invention.

FIG. 8 may show a detailed structure of each layer of the board. The 3-layers structure may be used in the manufacture of the board. The microstrip feeding line 801 may be located on a first layer, and the slotted ground plane 802, which is pierced by aperture, may be disposed on a second layer. A patch element 803 and the ground plane 804 may be disposed on a third layer. For example, the microstrip feeding line 801 may feed the signal to the microstrip circuit at the first layer, the slotted ground plane 802 may include a slot to minimize a ratio of backward propagation wave to forward propagation wave at the second layer, and the ground plane may include a via 807 to make an electrical connection between the slotted ground plane 802 and the ground plane 804 at the third layer. Herein, a via 807 may be disposed as an array.

A core substrate 805 between the first and the second layer may be made of Taconic. CER-10 having dimensions of 12 mm×5.68 mm and thickness of 0.28 mm. Another core substrate 806 between the second and the third layer may be made of Rogers. RO3010 Prepreg having dimensions of 12 mm×5.68 mm and thickness of 0.287 mm.

The Via 807 may play a role of making an electrical connection between the second and the third ground plane. The microstrip width, the substrate thickness, the slot size, the patch size, the via diameter, the via spacing, the waveguide size, the waveguide material may be modified depending on a particular resonance frequency of the microstrip circuit and the mode of the propagation wave along the electrical fiber, as it will be apparent to one skilled in the art.

Specially, the size of the slot and the aperture may be an important factor in the transmission and reflection of the signal. Those sizes may be optimized to minimize the ratio of backward propagation wave to forward propagation wave by iterative simulation. A cutoff frequency and an impedance of waveguide may be determined by the dimensions of the cross section and a kind of material used. For this invention, the dimensions of 2.9 mm×2.7 mm and ECCOSTOCK PP (Laird TECHNOLOGIES.) may be used to pass 60 GHz band signal with a minimum reflection at the MWT. The larger the size of the cross section of the waveguide is, the larger the number of the TE/TM modes may be able to propagate. And it may lead to improvement in the insertion loss of the transition.

Figure 9:
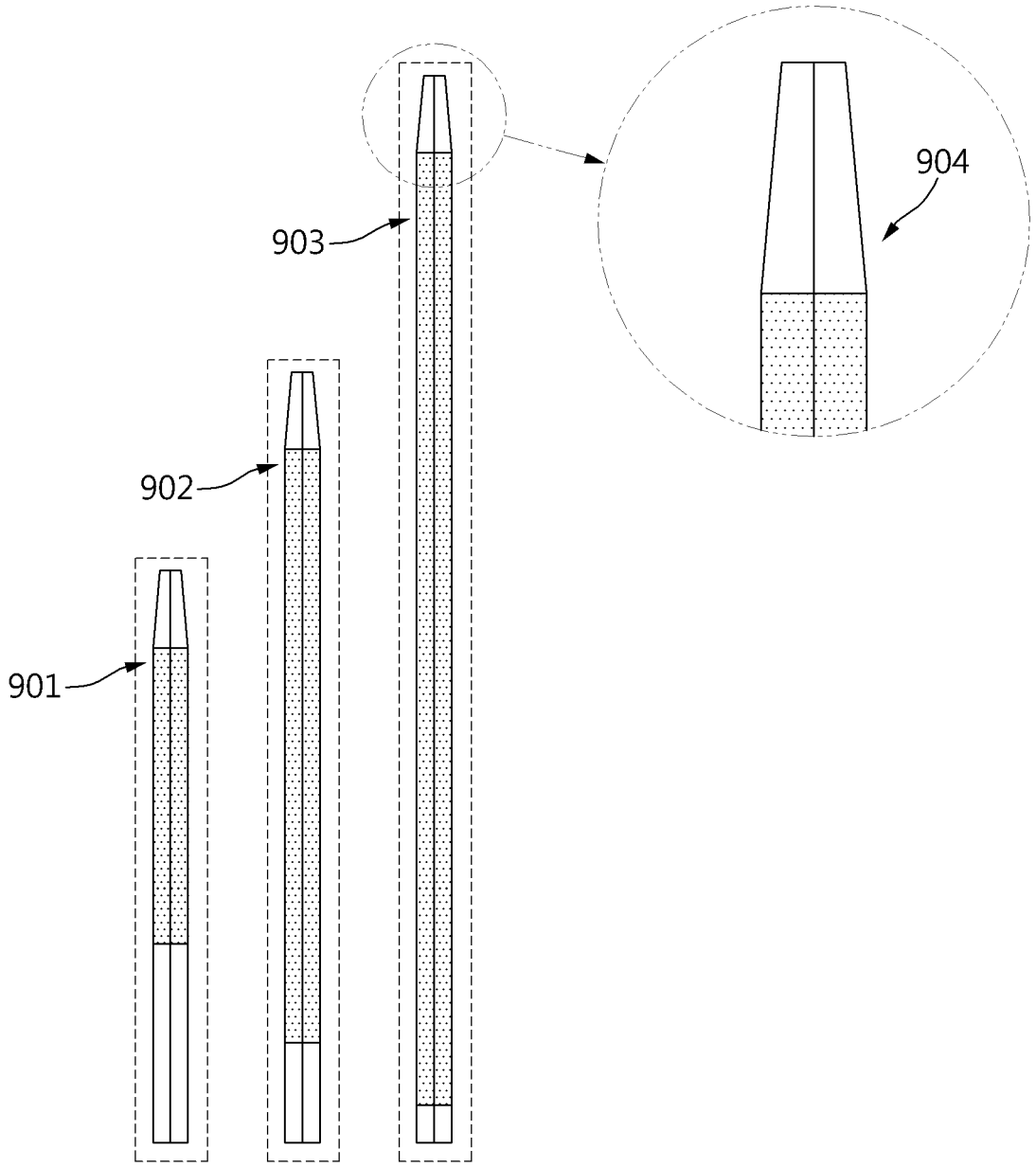
FIG. 9 shows an isometric view of different length of an electrical fiber with that of metal cladding and tapered waveguide constructed in accordance with the invention.

FIG. 9 shows an exploded isometric view of different length of the electrical fiber with that of metal cladding and tapered waveguide constructed in accordance with one embodiment of the invention.

To reduce the impact of the oscillation in the result of S-parameter, not only minimizing the reflection occurred at the MWT but taking optimized attenuation along the electrical fiber 901, 902, 903 may be used. This strategy may be embodied by shortening a length of the metal cladding which wraps up the dielectric waveguide of the electrical fiber 901, 902, 903 at each end. The metal cladding may perfectly confine the electromagnetic wave preventing a radiation loss of energy. For this reason, utilizing a short metal cladding may result in a large radiation loss. This kind of energy loss may be considered as attenuation along the electrical fiber 901, 902, 903 and it may greatly influence the oscillation in the result of S-parameter.

Also, the dielectric loss may be considered as attenuation along the electrical fiber 901, 902, 903. It may result from a tangent loss of the dielectric waveguide and be relevant to the length of waveguide. The dielectric loss dissipated along the long waveguide may reduce the effect of the oscillation.

Therefore, long electrical fiber 903 may have bigger proportionality of metal cladding than short electrical fiber 901 while taking same amount of channel loss. One end of the electrical fiber 904 may indicate the isometric drawing of a tapered waveguide. It may be for the impedance matching between the dielectrics used for the dielectric waveguide and the microstrip circuits on the board. For example, a proportionality of a length of the metal cladding on a length of the dielectric waveguide may be designed based on a length of the electrical fiber 901, 902, 903.

Also, based on the well-known fact that the dimensions of the waveguide determines its impedance, linearly shaping at least one of both ends of the dielectric waveguide may be efficient for finding optimal impedance. Specifically, at least one of both ends of the dielectric waveguide may be tapered for impedance matching between the dielectric waveguide and microstrip circuits. For example, at least one of both ends of the dielectric waveguide may be shaped linearly to optimize an impedance of the dielectric waveguide with largest power transfer efficiency.

In accordance with one embodiment of the present invention, the interconnection device with the electrical fiber 901, 902, 903 for a board-to-board interconnect between transceiver I/O, the interconnection device comprising, the electrical fiber 901, 902, 903 to propagate the signal from the transmitter side board to the receiver side board with the metal cladding and the microstrip circuit to contact with the electrical fiber 901, 902, 903 with the MWT.

Figure 10:
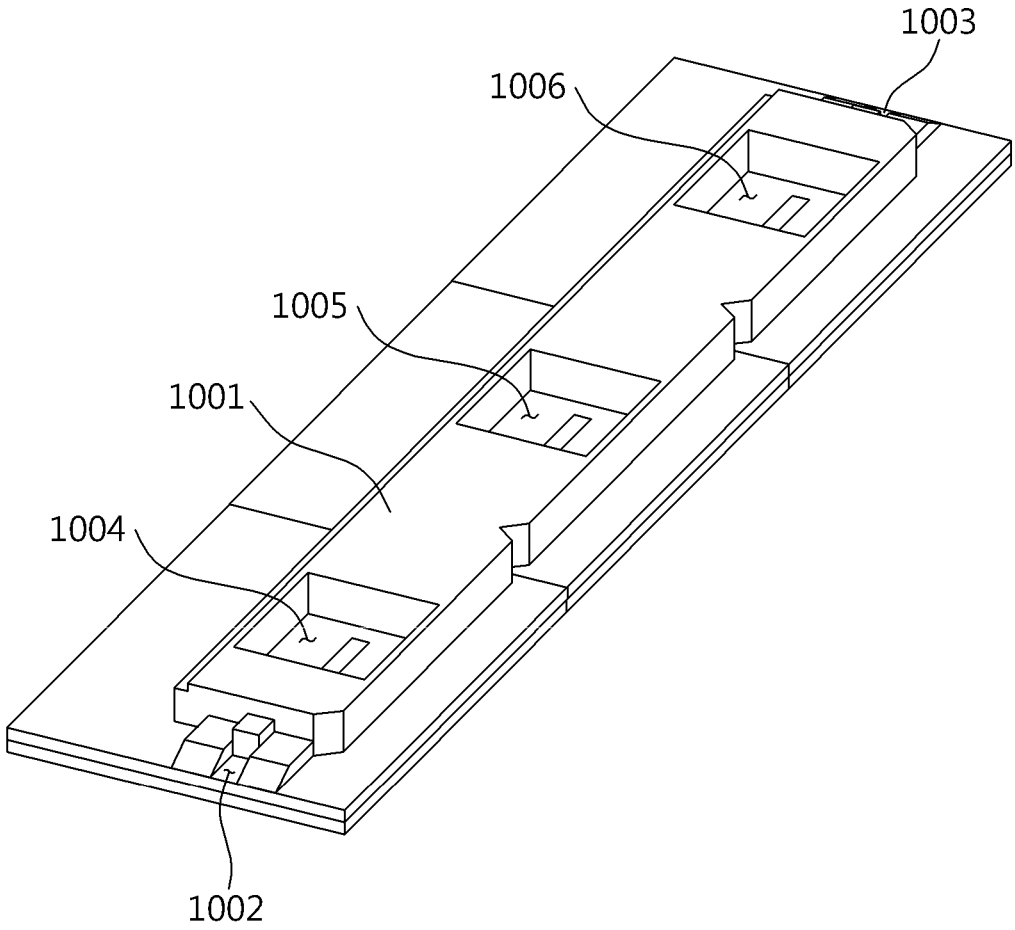
FIG. 10 shows an isometric view of a board-to-waveguide connector constructed in accordance with the invention.

FIG. 10 shows an isometric view of a board-to-waveguide connector constructed in accordance with the invention.

FIG. 10 may show an isometric view of the board-to-fiber connector 1001. The electrical fiber may be firmly fixed to the board with the board-to-fiber connector 1001. Connector bridges 1002, 1003 may be inserted into holes bored through the board to fix it on the board. For example, the board-to-fiber connector 1001 connects the electrical fiber to at least one of the transmitter side board and the receiver side board vertically.

Also there may be an array of transition apparatuses 1004, 1005, 1006 in the connector for physical fixation of the electrical fiber. Using this connector, the electrical fiber may contact the microstrip circuit on the board. It may be a very efficient way for saving an area that the both end sides of the dielectric waveguide are vertically coupled with the transmitter side board and the receiver side board as illustrated in the FIG. 10. Because of this configuration, a number of the electrical fiber may be used to connect the multiple channels concurrently for a parallel system with wide bandwidth. For example, the dielectric waveguide may be vertically coupled with at least one of the transmitter side board and the receiver side board.

Figure 11:
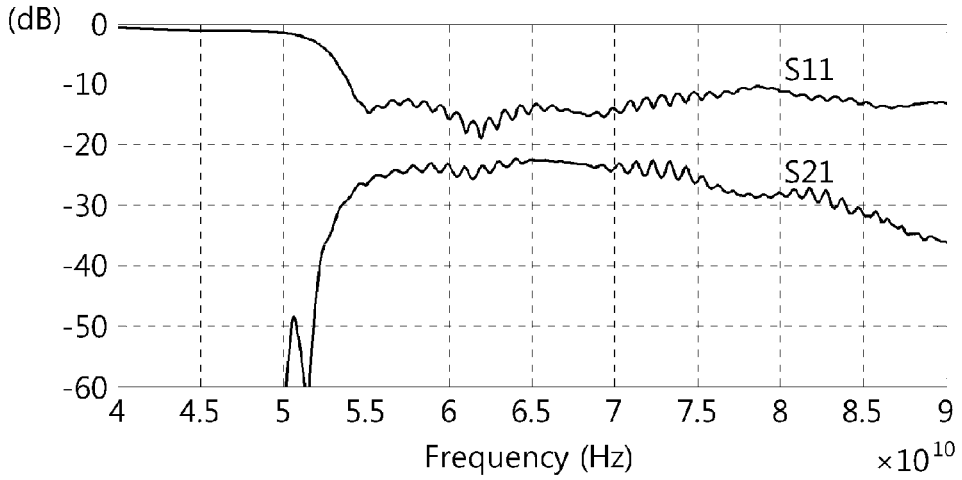
FIG. 11 shows a graph of simulated results for S-parameters of the overall interconnect constructed in accordance with the invention.

FIG. 11 shows a graph of simulated results for S-parameters of the overall interconnect constructed in accordance with one embodiment of the invention.

Referring to FIG. 11, simulated results for S-parameters of the overall interconnect constructed in accordance with one embodiment of the invention may be shown in the graph. For example, the results may be achieved using the 50 cm electrical fiber. For a return loss of 10 dB, a 15 GHz bandwidth, from 54 GHz to 79 GHz, may be achieved. The insertion loss on the passband may be found to be less than 15 dB and also constant along the wide band.

Figure 12:
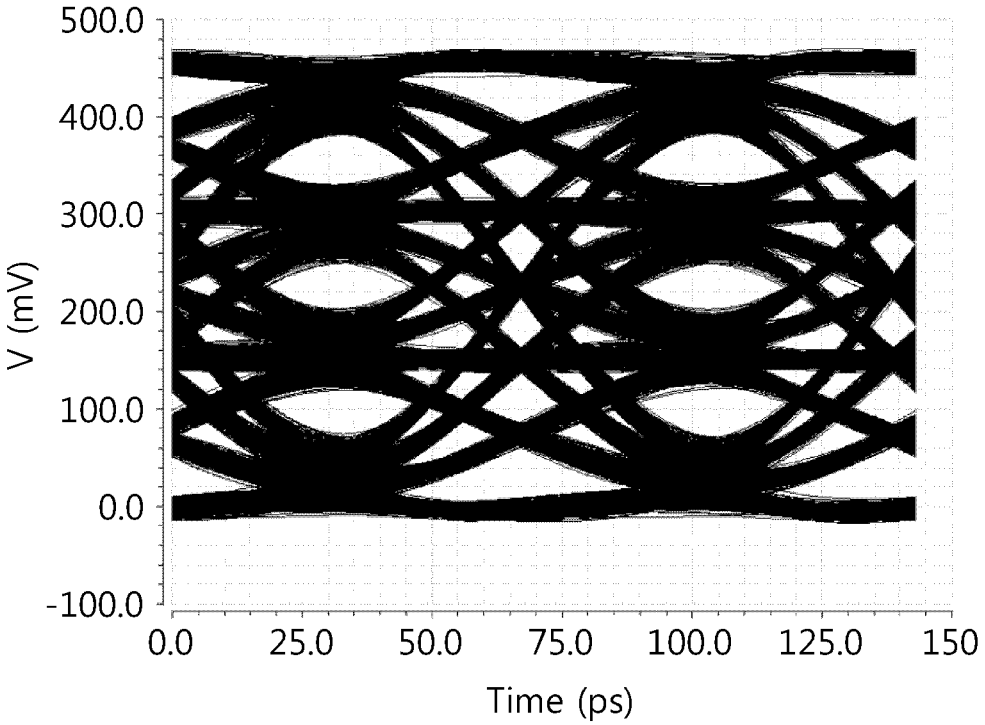
FIG. 12 shows a graph of simulated results for Eye diagram of demodulated PAM4 28 Gbps PRBS $2^{14}-1$ for 65 GHz channel.

FIG. 12 shows a graph of simulated results for Eye diagram of PAM4 28 Gbps PRBS $2^{14}-1$ for 65 GHz channel.

To evaluate the performance of the overall interconnect, FIG. 12 may show an Eye-diagram of PAM4 28 Gbps PRBS $2^{14}-1$. The Eye-diagram may represent the demodulated data pattern which may be modulated on the 65 GHz carrier and passed through the channel of the interconnect constructed in accordance with an exemplary embodiment.

The electrical fiber may propose a new method to make high-speed data communication possible. The MWT structure may transit the wideband signal while minimizing the reflection at the discontinuity. The metal cladding which wraps up the dielectric waveguide may reduce the radiation loss and be effective to decrease the channel loss.

Moreover, if a center frequency may move to higher frequency band, a wider bandwidth may be achieved without any additional complexity or cost. Therefore, the electrical fiber may be promising solution to I/O channel having a demand to transmit data with very high-speed. Especially, the electrical fiber may be able to replace the all copper wire line in the 100 Gbps backplane interface based on the IEEE 802.3 bj KR standard. And it may be applied to IEEE 802.3 bj SR standard with lengthened transmission distance. A board-to-board interface may take the electrical fiber as a prospective solution in the datacenter market.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A board-to-board interconnection device with an electrical fiber, the interconnection device comprising:

an electrical fiber to propagate a signal from a transmitter side board to a receiver side board with a metal cladding;

a microstrip circuit to contact with the electrical fiber with a microstrip-to-waveguide transition (MWT), a microstrip feeding line to feed the signal to the microstrip circuit at a first layer;

a slotted ground plane including a slot to minimize a ratio of backward propagation wave to forward propagation wave at a second layer;

a ground plane including an array of vias to make an electrical connection between the slotted ground plane and the ground plane at a third layer; and a patch to radiate the signal at a resonance frequency.

2. The interconnection device of claim 1, wherein at least one of both ends of the electrical fiber is tapered for impedance matching between the electrical fiber and the microstrip circuit on the interconnection device.

3. The interconnection device of claim 1, wherein at least one of both ends of the electrical fiber is shaped linearly to optimize an impedance of the electrical fiber with a largest power transfer efficiency.

4. The interconnection device of claim 1, wherein the metal cladding comprises copper cladding.

5. The interconnection device of claim 1, wherein the interconnection device further comprises, a board-to-fiber connector to connect the electrical fiber to at least one of the transmitter side board and the receiver side board vertically.

6. The interconnection device of claim 1, wherein a proportionality of a length of the metal cladding on a length of the electrical fiber is designed based on a length of the electrical fiber.

* * * * *